US006938982B2

(12) United States Patent
Chang et al.

(10) Patent No.: US 6,938,982 B2
(45) Date of Patent: Sep. 6, 2005

(54) METHOD FOR MAINTAINING INKJET CHIP OF AN INKJET DEVICE

(75) Inventors: Shih-Yen Chang, Taipei (TW); Chien-Hsien Ho, Ilan (TW); Wen-Chi Chang, Taiping (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 10/452,965

(22) Filed: Jun. 2, 2003

(65) Prior Publication Data

US 2003/0227508 A1 Dec. 11, 2003

(30) Foreign Application Priority Data

Jun. 7, 2002 (TW) ..... 91112400 A

(51) Int. Cl.[7] ..... B41J 2/165
(52) U.S. Cl. ..... 347/33; 347/28
(58) Field of Search ..... 347/22, 28, 33, 347/29, 32, 23

(56) References Cited

U.S. PATENT DOCUMENTS 5,563,638 A * 10/1996 Osborne ..... 347/32
6,601,943 B2 8/2003 Barinaga

FOREIGN PATENT DOCUMENTS

JP 05-162320 6/1993

* cited by examiner

*Primary Examiner*—Shih-wen Hsieh
(74) *Attorney, Agent, or Firm*—Ladas & Parry LLP

(57) ABSTRACT

A method for maintaining the inkjet chip of an inject device. The inkjet device comprises an ink cartridge, a carrier, a wiper and a wiper stage. The carrier is used to load the ink cartridge. The wiper stage is used to load the wiper. The ink cartridge contains ink and has an inkjet chip. The inkjet chip has at least a set of inkjet nozzles. The method comprises the steps of: (a) relatively moving the carrier onto the wiper stage to locate the wiper to a position where the wiper can wipe the inkjet chip; (b) spraying the ink contained in the ink cartridge onto the wiper to moisturize the wiper; and (c) relatively reciprocating the wiper stage and the carrier to make the wiper wipe the inkjet chip.

25 Claims, 5 Drawing Sheets

METHOD FOR MAINTAINING INKJET CHIP OF AN INKJET DEVICE

BACKGROUND OF THE INVENTION

1. Field of the Invention

The present invention relates to a method for maintaining the inkjet chip of an inkjet device, and in particular to a method for spraying ink on a wiper and wiping the inkjet chip of the inkjet device with the wiper.

2. Description of the Related Art

In order to promote printing performance, the size of the inkjet nozzle of the current ink cartridge has increasingly decreased. An inkjet nozzle jam thus occurs frequently. Thus, maintenance for an inkjet device such as an inkjet printer has become increasingly important.

As mentioned above, the inkjet nozzle of the current ink cartridge is very small. Crystals are formed on the surface of the inkjet chip due to chemical reaction between the ink and the air, thus causing the inkjet nozzle jam. The current maintaining method substantially includes spraying and wiping. Powerful spraying causes an unnecessary waste of the ink. In addition, frequent spraying results in shortened life of the resistor in the ink heater.

In another aspect, dry wiping without spraying causes scrapes on the surface of the inkjet chip. The scrapes are formed because the surface of the inkjet chip is not wet enough, and the ink crystals or other matters deposited on the surface of the inkjet chip can cause scraping during dry wiping.

Thus, a conventional maintenance method combining wiping with spraying is developed to overcome the aforementioned problems. The ink is sprayed on a sponge, and a wiper is used to wipe the surface of the inkjet chip. Each wiping step is performed when each spraying step is finished. Thus, the conventional maintenance method is time-consuming.

Consequently, an object of the invention is to provide a method for maintaining the inkjet chip of an inject device. The steps of spraying and wiping of the invention are performed simultaneously. Thus, scraping does not occur on the surface of the inkjet chip and the time for maintenance is enormously reduced.

SUMMARY OF THE INVENTION

An object of the invention is to provide a method for maintaining the inkjet chip of an inkjet device. The inkjet device comprises an ink cartridge, a carrier, a wiper and a wiper stage. The carrier is used to carry the ink cartridge. The wiper stage is used to carry the wiper. The ink cartridge contains ink and has an inkjet chip. The method comprises the steps of: (a) relatively moving the carrier onto the wiper stage to locate the wiper on a position to wipe the inkjet chip; (b) spraying the ink contained in the ink cartridge onto the wiper to moisturize the wiper; and (c) relatively reciprocating the wiper stage and the carrier to make the wiper wipe the inkjet chip.

A detailed description will be given in the following embodiments with reference to the accompanying drawings.

BRIEF DESCRIPTION OF THE DRAWINGS

The present invention can be more fully understood by reading the subsequent detailed description and examples with reference made to the accompanying drawings, wherein.

DETAILED DESCRIPTION OF THE INVENTION

Figure 1:
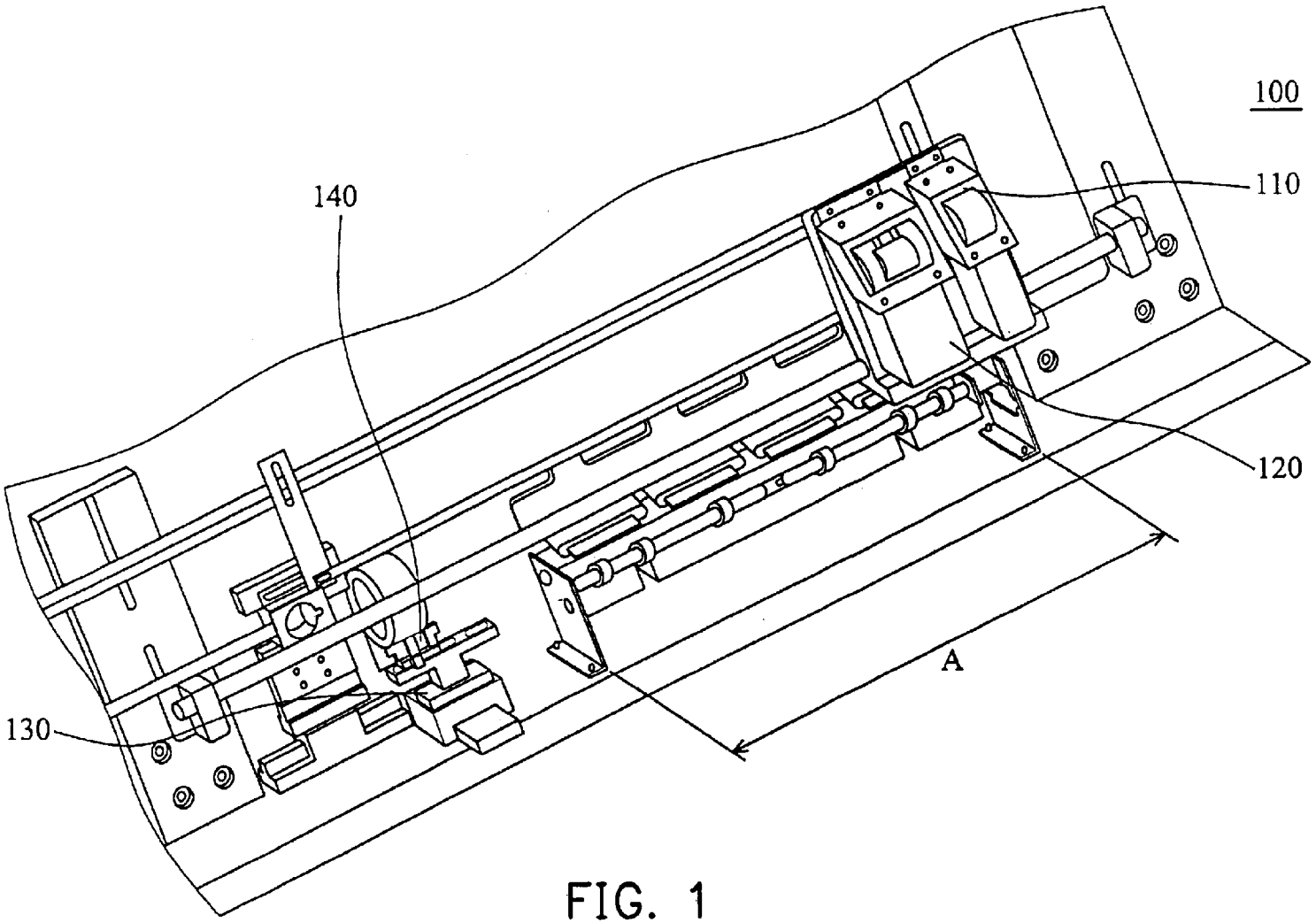
FIG. 1 shows the inkjet device for use with the method of the invention.
Figure 4:
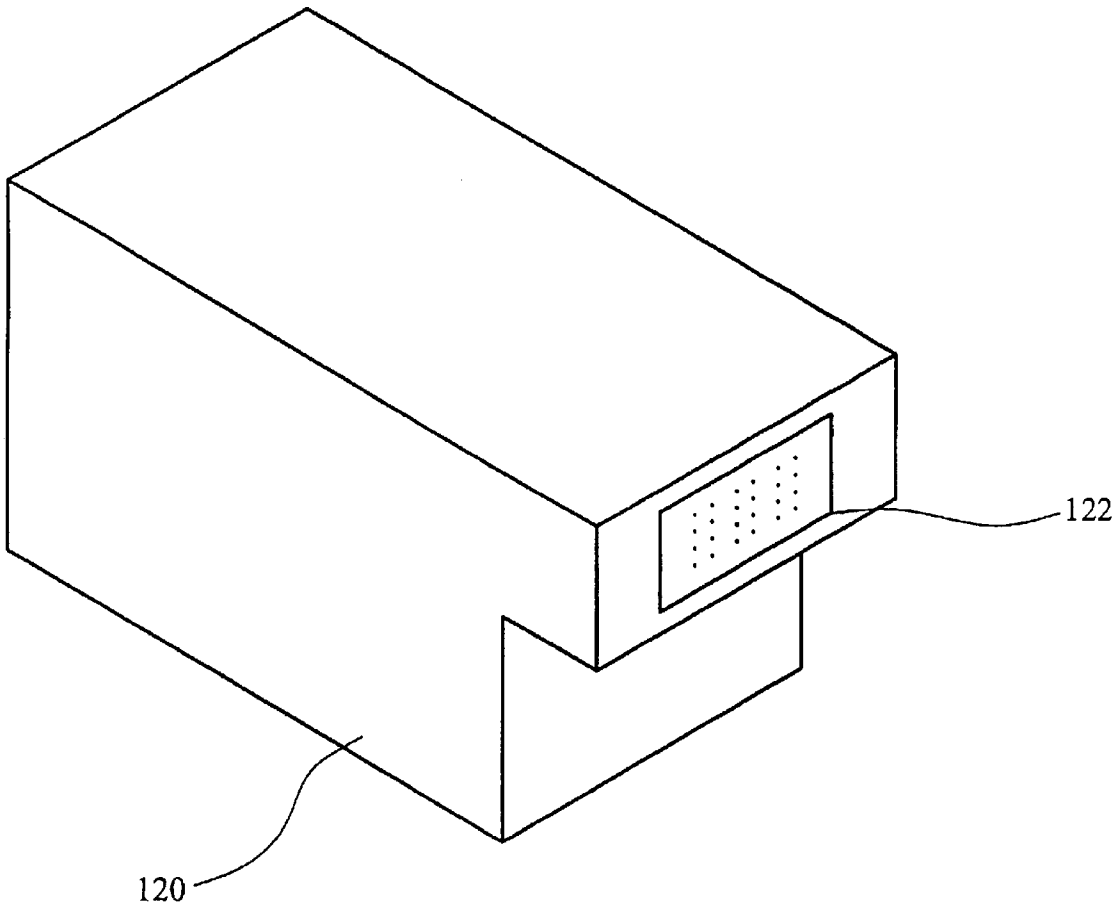
FIG. 4 shows the ink cartridge having an inkjet chip.

Referring to FIG. 1, the inkjet device 100 comprises a carrier 110, an ink cartridge 120, a wiper stage 130 and a wiper 140. The carrier 110 is used to carry the ink cartridge 120. The wiper stage 130 is used to carry the wiper 140. The wiper 140 is made of a rubber material. The ink cartridge 120 contains ink and has an inkjet chip 122 disposed thereunder, a shown in FIG. 4.

As shown in FIG. 1, when the inkjet device 100 performs the printing work, the carrier 110 and the ink cartridge 120 operate in the printing area A.

Figure 2:
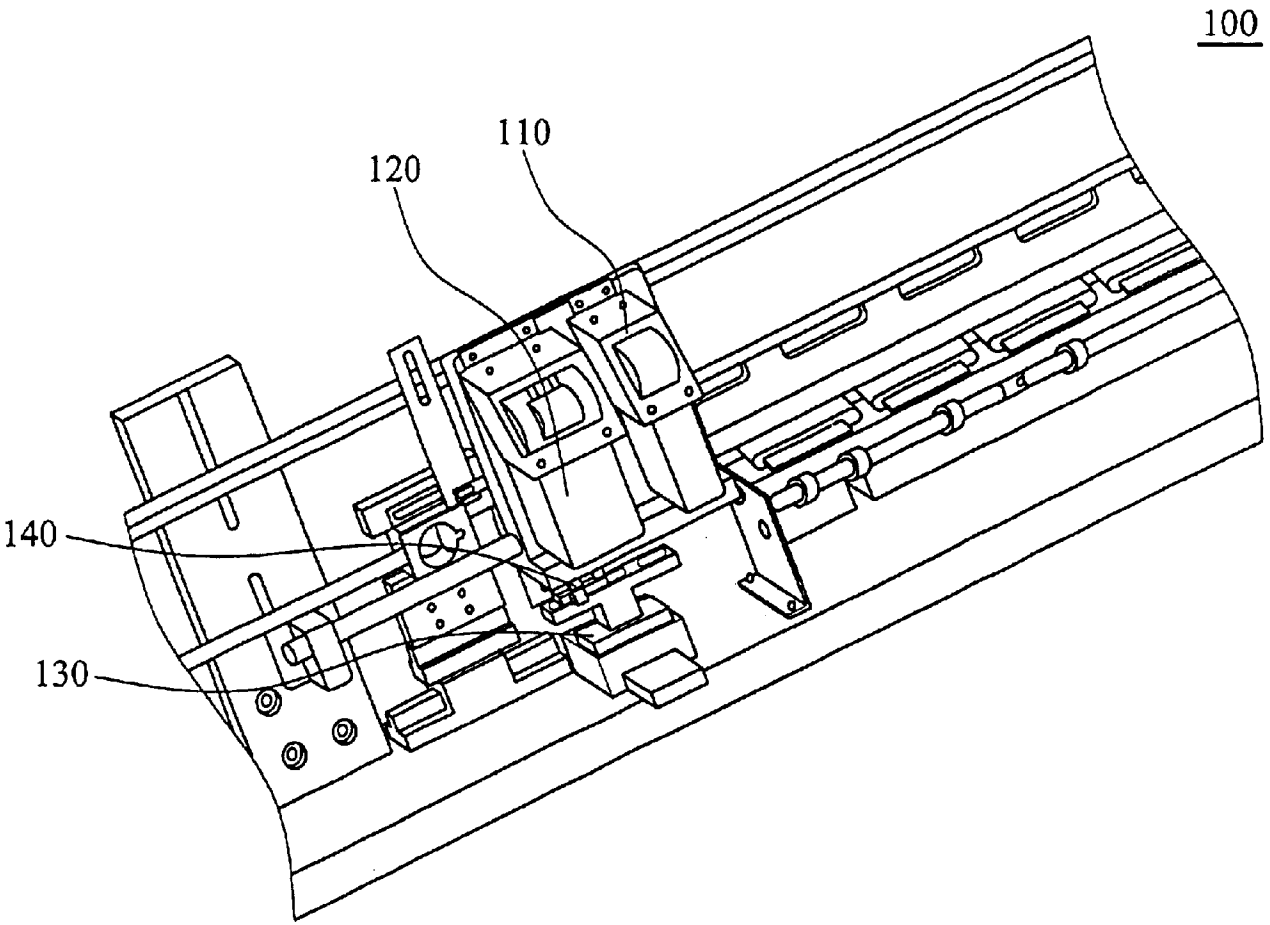
FIG. 2 shows that the ink cartridge and the carrier of the inkjet device are moved onto the wiper stage.
Figure 3:
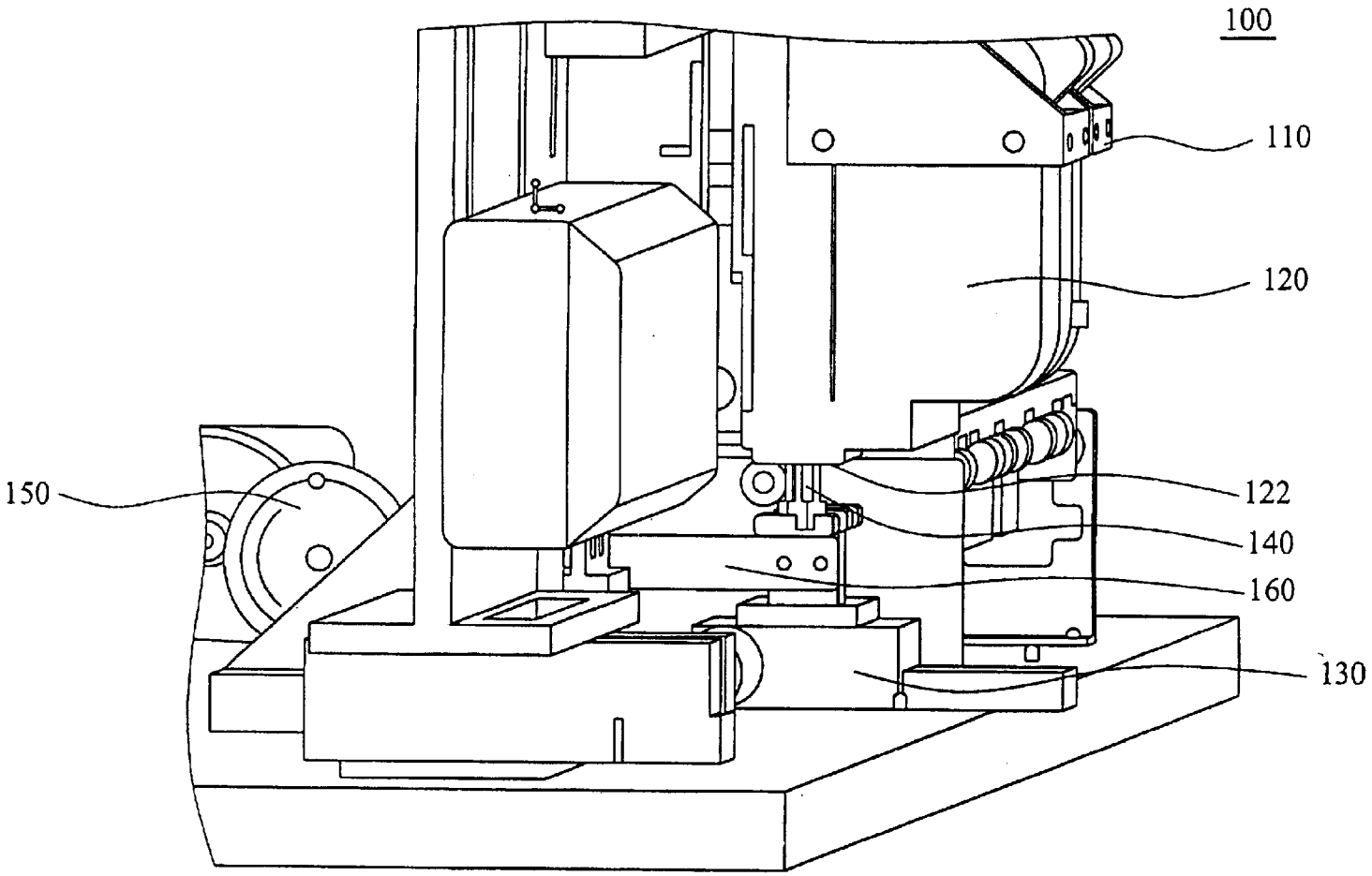
FIG. 3 is a side view according to FIG. 2.

Referring to FIG. 2, when the count of the ink drops sprayed from the ink cartridge 120 reaches a predetermined value, the inkjet device 100 generates a maintenance signal to move the carrier 110 onto the wiper stage 130. At this time, the inkjet chip 122 of the ink cartridge 120 is located above the wiper stage 130. Meanwhile, the inkjet chip 122 sprays the ink at a low frequency (2~5 kHz) onto the wiper 140 to dampen the wiper 140. Because the ink spraying speed cannot be faster than the ink refill speed, the inkjet chip 122 sprays the ink at the low frequency. Then, as shown in FIG. 3, since the wiper stage 130 is connected to a driving motor 150 by a linking shaft 160, the wiper stage 130 can reciprocate to make the wiper 140 wipe the inkjet chip 122 by reciprocation of the linking shaft 160 actuated by the driving motor 150.

As mentioned above, the spraying and wiping are performed repeatedly and simultaneously. Additionally, after the aforementioned spraying and wiping operations are completed, the wiper 140 can still wipe the inkjet chip 122 without spraying the ink onto the wiper 140. Thus, any residual particles can be completely cleaned away.

Figure 5:
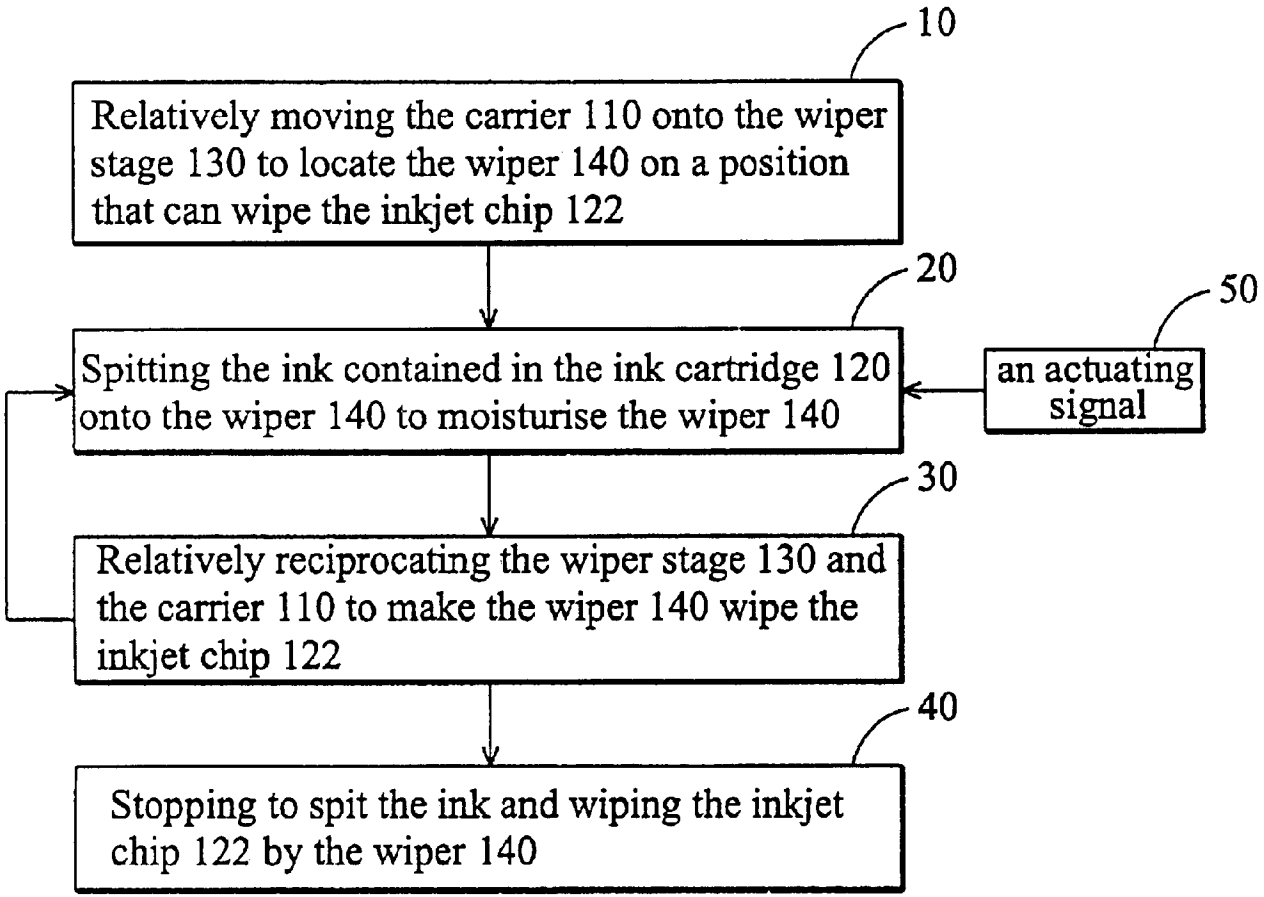
FIG. 5 is a flowchart showing the method for maintaining the inkjet chip of the inkjet device.

FIG. 5 is a flowchart showing the method for maintaining the inkjet chip of the inkjet device. Step 10, relatively moves the carrier 110 onto the wiper stage 130 to locate the wiper 140 to a position where it can wipe the inkjet chip 122. In step 50 an actuating signal is inputted. In step 20 ink contained in the ink cartridge 120 is sprayed onto the wiper 140 to moisturize the wiper 140. Step 30, relatively reciprocates the wiper stage 130 and the carrier 110 to make the wiper 140 wipe the inkjet chip 122. In step 40 ink spraying stops and the inkjet chip 122 is wiped by the wiper 140. Specifically, steps 20 and 30 can be performed repeatedly and simultaneously.

In addition to the aforementioned maintenance method utilizing the ink contained in the ink cartridge 120 to wipe the inkjet chip 122, the method for maintaining the inkjet chip 122 can be applied in another inkjet device (not shown) having a cleaning liquid storage tank (not shown). The cleaning liquid storage tank can be carried by the carrier. The steps of maintenance for the other inkjet device are the same as those for the inkjet device 100. The other inkjet device sprays the cleaning liquid rather than the ink onto the wiper 140 to wipe the inkjet chip 122. Thus, maintenance efficiency can be enhanced.

While the invention has been described by way of example and in terms of the preferred embodiment, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for maintaining an inkjet chip of an inkjet device, the inkjet device comprising an ink cartridge, a carrier, a wiper and a wiper stage, the carrier carrying the ink cartridge, the wiper stage carrying the wiper, the ink cartridge containing ink and having the inkjet chip, comprising:

(a) relatively moving the carrier onto the wiper stage to locate the wiper to a position where the wiper can wipe the inkjet chip; and (b) spraying the ink contained in the ink cartridge onto the wiper to moisturize the wiper; and simultaneously with spraying the ink reciprocating the wiper stage and the carrier to make the wiper wipe the inkjet chip.

2. The method for maintaining the inkjet chip of an inkjet device as claimed in claim 1, further comprising:

(c) after ink spraying stops, immediately wiping the inkjet chip by the wiper.

3. The method for maintaining the inkjet chip of an inkjet device as claimed in claim 1, wherein the wiper is made of a rubber material.

4. The method for maintaining the inkjet chip of an inkjet device as claimed in claim 1, wherein the inkjet device further comprises a driving motor for relatively moving the wiper stage and the carrier.

5. The method for maintaining the inkjet chip of an inkjet device as claimed in claim 1, wherein (b), an actuating signal is inputted to the inkjet chip to spit the ink.

6. Computer program, said program executing the method according to claim 1 when being run on a data-processing means.

7. Computer program comprising program code means for performing the method steps according to claim 1 when said program is run on a data-processing means.

8. Computer program comprising program code means according to claim 7 that are stored on a computer-readable data carrier.

9. Data carrier, on which a data structure is stored which causes a data-processing means to execute the method according to claim 1 when loaded into a memory of said data-processing means.

10. A method for maintaining an inkjet chip of an inkjet device, the inkjet device comprising an ink cartridge, a carrier, a wiper and a wiper stage, the ink cartridge having an inkjet chip and a storage tank containing cleaning liquid, the carrier carrying the ink cartridge, the wiper stage carrying the wiper, comprising:

(a) relatively moving the carrier onto the wiper stage to locate the wiper to a position where the wiper can wipe the inkjet chip;

(b) spraying the cleaning liquid onto the wiper to moisturize the wiper; and (c) relatively reciprocating the wiper stage and simultaneously with spraying the cleaning liquid the carrier to make the wiper wipe the inkjet chip.

11. The method for maintaining the inkjet chip of an inkjet device as claimed in claim 10, wherein (b) and (c) are performed repeatedly.

12. The method for maintaining the inkjet chip of an inkjet device as claimed in claim 10, further comprising:

(d) after cleaning liquid spraying stops, immediately wiping the inkjet chip by the wiper.

13. The method for maintaining the inkjet chip of an inkjet device as claimed in claim 10, wherein the wiper is made of a rubber material.

14. The method for maintaining the inkjet chip of an inkjet device as claimed in claim 10, wherein the inkjet device further comprises a driving motor for relatively moving the wiper stage and the carrier.

15. The method for maintaining the inkjet chip of an inkjet device as claimed in claim 10, wherein in (b), an actuating signal is inputted to the inkjet chip to spit the cleaning liquid.

16. A method for maintaining an inkjet chip of an inkjet device, the inkjet device comprising an ink cartridge, a carrier, a wiper and a wiper stage, the carrier carrying the ink cartridge, the wiper stage carrying the wiper, the ink cartridge containing a liquid and having an inkjet chip, comprising:

(a) relatively moving the carrier and the wiper stage to locate the wiper to a position where the wiper can wipe the inkjet chip; and (b) spraying the liquid onto the wiper to moisturize the wiper and reciprocating the wiper and the carrier relatively and simultaneously to make the wiper wipe the inkjet chip.

17. The method for maintaining the inkjet chip of an inkjet device as claimed in claim 16, wherein the wiper is made of a rubber material.

18. The method for maintaining the inkjet chip of an inkjet device as claimed in claim 16, wherein the inkjet device further comprises a driving motor for relatively moving the wiper stage and the carrier.

19. The method for maintaining the inkjet chip of an inkjet device as claimed in claim 16, wherein in (b), an actuating signal is inputted to the inkjet chip to spray the liquid.

20. The method for maintaining the inkjet chip of an inkjet device as claimed in claim 16, further comprising:

(c) after liquid spraying stops, immediately wiping the inkjet chip by the wiper.

21. A method for maintaining an inkjet chip of an inkjet device, the inkjet device comprising an ink cartridge, a carrier, a wiper and a wiper stage, the ink cartridge having an inkjet chip and a storage tank containing cleaning liquid, the carrier carrying the ink cartridge, the wiper stage carrying the wiper, comprising:

(a) relatively moving the carrier onto the wiper stage to locate the wiper to a position where the wiper can wipe the inkjet chip; and (b) spraying the cleaning liquid onto the wiper to moisturize the wiper and reciprocating the wiper stage and the carrier relatively and simultaneously to make the wiper wipe the inkjet chip.

22. The method for maintaining the inkjet chip of an inkjet device as claimed in claim 21, further comprising:

after cleaning liquid spraying stops, immediately wiping the inkjet chip by the wiper.

23. The method for maintaining the inkjet chip of an inkjet device as claimed in claim 21, wherein the wiper is made of a rubber material.

24. The method for maintaining the inkjet chip of an inkjet device as claimed in claim 21, wherein the inkjet device further comprises a driving motor for relatively moving the wiper stage and the carrier.

25. The method for maintaining the inkjet chip of an inkjet device as claimed in claim 21, wherein in (b), an actuating signal is inputted to the inkjet chip to spit the cleaning liquid.

* * * * *